US008128200B2

(12) United States Patent
Kasahara et al.

(10) Patent No.: US 8,128,200 B2
(45) Date of Patent: Mar. 6, 2012

(54) FLUID EJECTING APPARATUS AND METHOD OF EJECTING FLUID

(75) Inventors: Hirokazu Kasahara, Nagano (JP); Toru Takahashi, Nagano (JP); Toru Miyamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 393 days.

(21) Appl. No.: 12/544,005

(22) Filed: Aug. 19, 2009

(65) Prior Publication Data

US 2010/0053246 A1 Mar. 4, 2010

(30) Foreign Application Priority Data

Sep. 1, 2008 (JP) ..... 2008-223885

(51) Int. Cl.
*B41J 2/145* (2006.01)

(52) U.S. Cl. ..... 347/40; 347/41; 347/19

(58) Field of Classification Search ..... 347/5, 12, 347/19, 40, 41, 42
See application file for complete search history.

(56) References Cited

U.S. PATENT DOCUMENTS 5,384,587 A * 1/1995 Takagi et al. ..... 347/41
6,846,064 B2 * 1/2005 Yamane ..... 347/40

FOREIGN PATENT DOCUMENTS

JP 06-255175 A 9/1994

* cited by examiner

*Primary Examiner* — Lam S Nguyen
(74) *Attorney, Agent, or Firm* — Global IP Counselors, LLP

(57) ABSTRACT

The first head includes first nozzle rows each having a nozzle for ejecting a fluid of a first color and a nozzle for ejecting a fluid of a second color lined up in a color order in a cross direction. The second head includes second nozzle rows each having the two nozzles lined up in a color order in the cross direction. The controller controls a nozzle to dispose a plurality of color-overlapped dots to form a raster line, such that a ratio of A1 to "A1+A2" is larger than a ratio of B1 to "B1+B2" to form the raster line, where A1 and A2 donate amounts of a fluid of the first color from the first and second nozzle rows, respectively, and B1 and B2 donate amounts of a fluid of the second color from the first and second nozzle rows, respectively.

5 Claims, 7 Drawing Sheets

FLUID EJECTING APPARATUS AND METHOD OF EJECTING FLUID

This application claims priority to Japanese Patent Application No. 2008-223885 filed on Sep. 1, 2008. The entire disclosure of Japanese Patent Application No. 2008-223885 is hereby incorporated herein by reference.

BACKGROUND

1. Technical Field

The present invention relates to a fluid ejecting apparatus and a method of ejecting a fluid.

2. Related Art

A fluid ejecting apparatus is known which includes a head unit having a plurality of nozzles which eject fluids of different colors onto a medium, a movement mechanism which moves the medium relative to the head unit in a predetermined direction, and a controller which controls a nozzle to eject a fluid onto the medium which is moved by the movement mechanism and disposes a plurality of color-overlapped dots in the predetermined direction to form a raster line. For example, a line ink jet printer which is a printing apparatus is a representative example of the fluid ejecting apparatus.

The fluid ejecting apparatus includes: a head unit which includes a first head in which a plurality of first nozzle rows in each of which a nozzle for ejecting a fluid of a first color onto a medium and a nozzle for ejecting a fluid of a second color onto a medium are lined up in a color order wherein the first color is earlier than the second color in a predetermined direction and where the nozzles are lined up in a cross direction crossing the predetermined direction, and a second head which is disposed at a downstream side of the first head in the predetermined direction and in which a plurality of second nozzle rows, in which the two nozzles are lined up in a color order identical to the color order in the predetermined direction, are lined up in the cross direction. In the head unit, the first nozzle row, which is positioned on an end part of one end side of the first head in the cross direction, overlaps the second nozzle row, which is positioned on an end part of the other end side of the second head in the cross direction, in the cross direction, so that a composite nozzle row in which the first nozzle row and the second nozzle row are lined up in the predetermined direction is formed.

Japanese Unexamined Patent Application Publication No. 6-255175 is an example of related art.

In the fluid ejecting apparatus having the head unit, a controller controls a nozzle to eject a fluid onto the medium from the nozzles of the first nozzle row and the second nozzle row which belong to the composite nozzle row for each color and disposes a plurality of color-overlapped dots in the predetermined direction to form a raster line.

In this case, an image part configured by the raster line (i.e., an image part formed by a fluid ejected from the composite nozzle row) and an image part configured by a different raster line (i.e., an image part formed by a fluid ejected from a non-composite nozzle row which is not the composite nozzle row) are different in image characteristic, and thus there is a problem in that the image quality deteriorates.

SUMMARY

An advantage of some aspects of the invention is that it provides a fluid ejecting apparatus and a method of ejecting a fluid in which the image quality is improved.

According to an aspect of the invention, there is provided a fluid ejecting apparatus, including: a head unit, which includes a first head in which a plurality of first nozzle rows in each of which a nozzle for ejecting a fluid of a first color onto a medium and a nozzle for ejecting a fluid of a second color onto a medium are lined up in a color order, in which the first color is earlier than the second color in a predetermined direction and where the nozzles are lined up in a cross direction crossing the predetermined direction, and a second head which is disposed at a downstream side of the first head in the predetermined direction and in which a plurality of second nozzle rows in each where the two nozzles are lined up in a color order identical to the color order in the predetermined direction and are lined up in the cross direction, wherein the first nozzle row, which is positioned on an end part of one end side of the first head in the cross direction, overlaps the second nozzle row, which is positioned on an end part of the other end side of the second head in the cross direction, in the cross direction, so that a composite nozzle row in which the first nozzle row and the second nozzle row are lined up in the predetermined direction is formed; a movement mechanism which moves the medium relative to the head unit in the predetermined direction; and a controller which ejects a fluid onto the medium, which is moved by the movement mechanism, from nozzles of the first nozzle row and the second nozzle row which belong to the composite nozzle row for each color and disposes a plurality of color-overlapped dots in the predetermined direction to form a raster line, wherein the controller controls a nozzle to eject a fluid such that a first ratio of A1 to "A1+A2" is larger than a second ratio of B1 to "B1+B2" to form the raster line, where A1 denotes an amount of a fluid of the first color on the raster line ejected from the first nozzle row, A2 denotes an amount of a fluid of the first color on the raster line ejected from the second nozzle row, B1 denotes an amount of a fluid of the second color on the raster line ejected from the first nozzle row, and B2 denotes an amount of a fluid of the second color on the raster line ejected from the second nozzle row.

Other aspects of the invention are apparent from the specification and the accompanying drawings of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
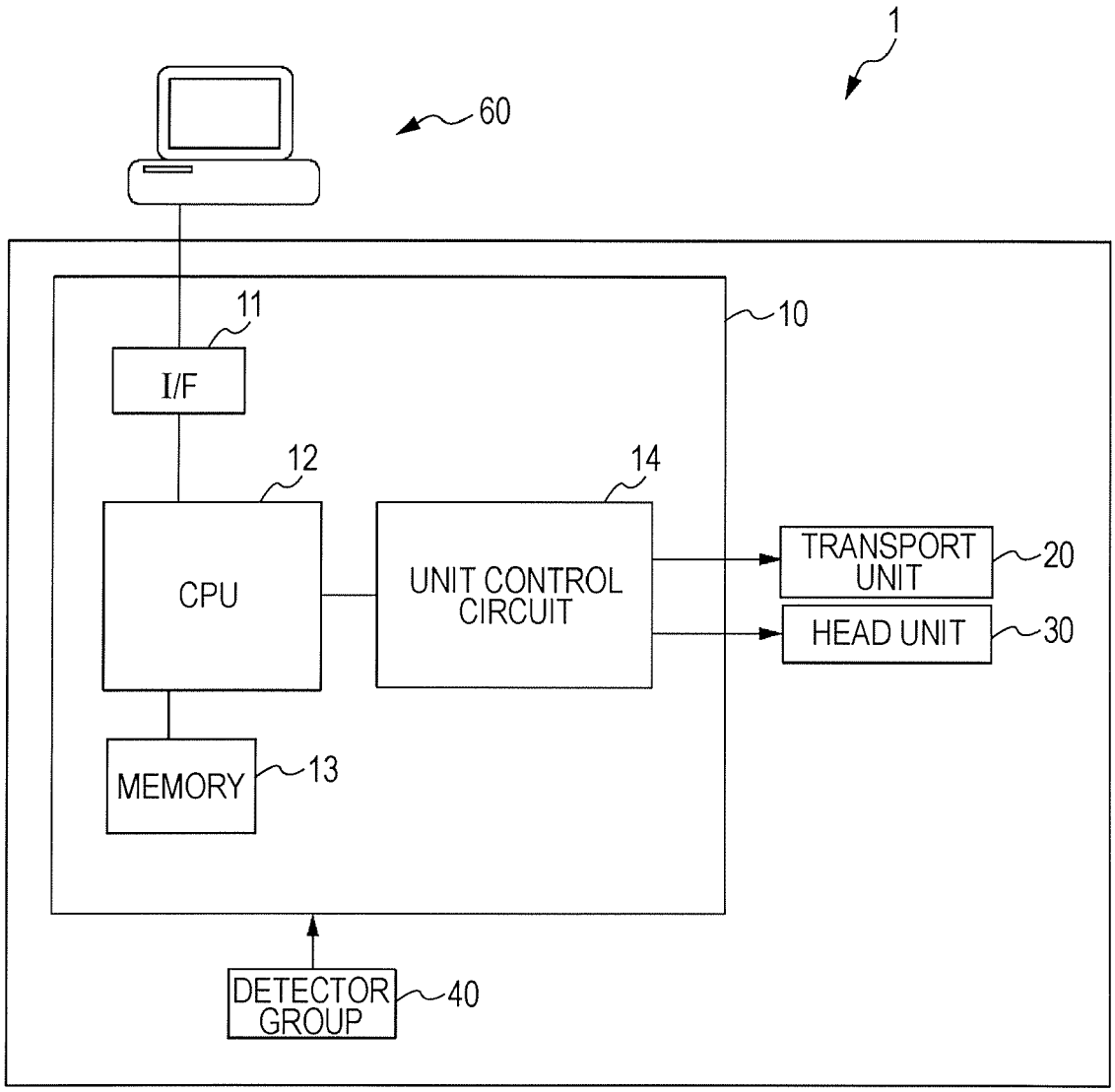
FIG. 1 is a block diagram illustrating an overall configuration of a printing system according to the present embodiment.

Aspects described below are apparent from disclosure of the specification and disclosure of the accompanying drawings of the invention.

According to an aspect of the invention, a fluid ejecting apparatus includes: a head unit which includes a first head in which a plurality of first nozzle rows in each of which a nozzle for ejecting a fluid of a first color onto a medium and a nozzle for ejecting a fluid of a second color onto a medium are lined up in a color order in which the first color is earlier than the second color in a predetermined direction and the nozzles are lined up in a cross direction crossing the predetermined direction and a second head which is disposed at a downstream side of the first head in the predetermined direction and in which a plurality of second nozzle rows in each, where the two nozzles are lined up in a color order identical to the color order in the predetermined direction, are lined up in the cross direction, wherein the first nozzle row, which is positioned on an end part of one end side of the first head in the cross direction, overlaps the second nozzle row, which is positioned on an end part of the other end side of the second head in the cross direction, in the cross direction, so that a composite nozzle row in which the first nozzle row and the second nozzle row are lined up in the predetermined direction is formed; a movement mechanism which moves the medium relative to the head unit in the predetermined direction; and a controller which controls a nozzle to eject a fluid onto the medium, which is moved by the movement mechanism, from nozzles of the first nozzle row and the second nozzle row which belong to the composite nozzle row for each color and disposes a plurality of color-overlapped dots in the predetermined direction to form a raster line, wherein the controller controls a nozzle to eject a fluid such that a first ratio of A1 to "A1+A2" is larger than a second ratio of B1 to "B1+B2" to form the raster line, where A1 denotes an amount of a fluid of the first color on the raster line ejected from the first nozzle row, A2 denotes an amount of a fluid of the first color on the raster line ejected from the second nozzle row, B1 denotes an amount of a fluid of the second color on the raster line ejected from the first nozzle row, and B2 denotes an amount of a fluid of the second color on the raster line ejected from the second nozzle row.

According to the fluid ejecting apparatus, an image characteristic difference between an image part formed by a fluid ejected from the non-composite nozzle row and an image part formed by a fluid ejected from the composite nozzle row is inhibited, whereby the image quality is improved.

In the head unit, the M first nozzle rows which are positioned on an end part of the one end side and the M second nozzle rows which are positioned on an end part of the other end side may overlap in the cross direction to form the M composite nozzles, and the controller may control a nozzle to eject a fluid onto the medium, which is moved by the movement mechanism, from nozzles of either of the first nozzle row and the second nozzle row which belong to the composite nozzle row for each color and for each of M composite nozzle rows and dispose a plurality of color-overlapped dots in the predetermined direction to form M raster lines and eject a fluid such that the first ratio and the second ratio are larger as the raster line in the M raster lines is closer to the other end side to form the raster line.

In this case, since an image in which an image characteristic smoothly changes in the cross direction can be obtained, the image quality is further improved.

The fluid ejecting apparatus may be a printer apparatus, and the controller may change the values of the first ratio and the second ratio according to the type of medium or the type of printing mode.

In this case, a value of the first ratio or a value of the second ratio can be set to an appropriate value in which a characteristic of the medium or a characteristic of the printing mode is considered.

In the first nozzle row and the second nozzle row, a nozzle for ejecting a cyan colored fluid on a medium, a nozzle for ejecting a magenta colored fluid on a medium, and a nozzle for ejecting a yellow colored fluid on a medium may be lined up in a color order of cyan, magenta, and yellow in the predetermined direction, and the controller may control a nozzle to eject a fluid onto the medium, which is moved by the movement mechanism, from nozzles of either of the first nozzle row and the second nozzle row which belong to the composite nozzle row for each of the three colors of cyan, magenta, and yellow, dispose a plurality of three color-overlapped dots in the predetermined direction to form the raster line, and eject a fluid to satisfy the relationship of a ratio of C1 to "C1+C2">a ratio of M1 to "M1+M2"> a ratio of Y1 to "Y1+Y2" to form the raster line, where C1 denotes an amount of a cyan colored fluid on the raster line ejected from the first nozzle row, C2 denotes an amount of a cyan colored fluid on the raster line ejected from the second nozzle row, M1 denotes an amount of a magenta colored fluid on the raster line ejected from the first nozzle row, M2 denotes an amount of a magenta colored fluid on the raster line ejected from the second nozzle row, Y1 denotes an amount of a yellow colored fluid on the raster line ejected from the first nozzle row, and Y2 denotes an amount of a yellow colored fluid on the raster line ejected from the second nozzle row.

In this case, an image characteristic difference between an image part formed by a fluid ejected from the non-composite nozzle row and an image part formed by a fluid ejected from the composite nozzle row is inhibited, whereby the image quality is further improved.

According to an aspect of the invention, a method of ejecting a fluid includes: preparing a head unit which includes a first head in which a plurality of first nozzle rows in each of which a nozzle for ejecting a fluid of a first color onto a medium and a nozzle for ejecting a fluid of a second color onto a medium are lined up in a color order in which the first color is earlier than the second color in a predetermined direction are lined up in a cross direction crossing the predetermined direction and a second head which is disposed at a downstream side of the first head in the predetermined direction, and in which a plurality of second nozzle rows in which the two nozzles are lined up in a color order identical to the color order in the predetermined direction are lined up in the cross direction, wherein the first nozzle row, which is positioned on an end part of one end side of the first head in the cross direction, overlaps the second nozzle row, which is positioned on an end part of the other end side of the second head in the cross direction, in the cross direction, so that a composite nozzle row in which the first nozzle row and the second nozzle row are lined up in the predetermined direction is formed; and ejecting a fluid onto the medium, which moves relative to the head unit in the predetermined direction, from nozzles of the first nozzle row and the second nozzle row which belong to the composite nozzle row for each color and disposing a plurality of color-overlapped dots in the predetermined direction to form a raster line, wherein a fluid is ejected such that a first ratio of A1 to "A1+A2" is larger than a second ratio of B1 to "B1+B2" to form the raster line, where A1 denotes an amount of a fluid of the first color on the raster line ejected from the first nozzle row, A2 denotes an amount of a fluid of the first color on the raster line ejected from the second nozzle row, B1 denotes an amount of a fluid of the second color on the raster line ejected from the first nozzle row, and B2 denotes an amount of a fluid of the second color on the raster line ejected from the second nozzle row.

According to the fluid ejecting method, an image characteristic difference between part of an image formed by fluid ejected from the non-composite nozzle row and part of an image part formed by fluid ejected from the composite nozzle row is inhibited, whereby the image quality is improved.

BRIEF SUMMARY OF A FLUID EJECTING APPARATUS ACCORDING TO THE PRESENT EMBODIMENT

Configuration Example of a Printing System

Figure 2A:
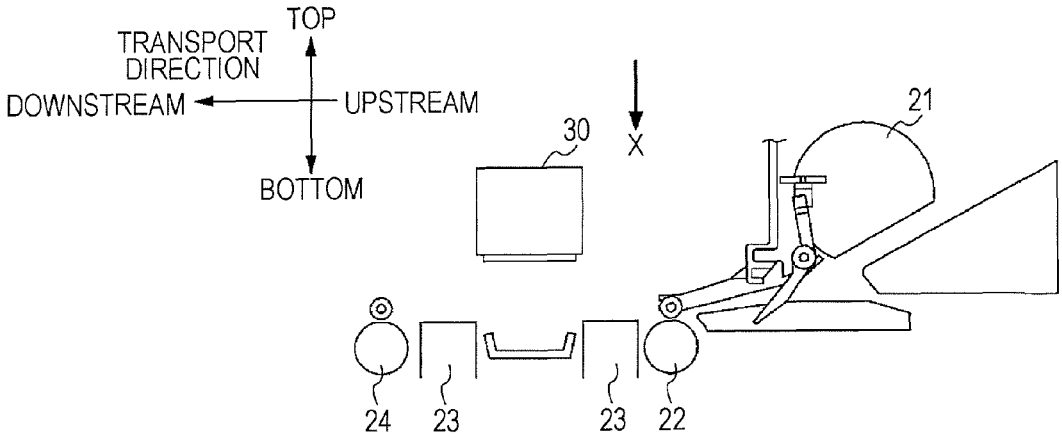
FIG. 2A is a cross-sectional view of a printer 1.
Figure 2B:
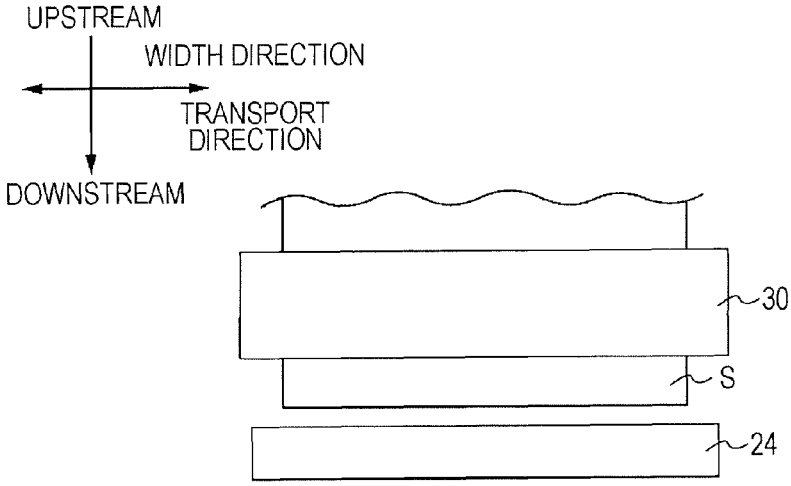
FIG. 2B is a view illustrating a state in which a printer 1 transports paper S.
Figure 3:
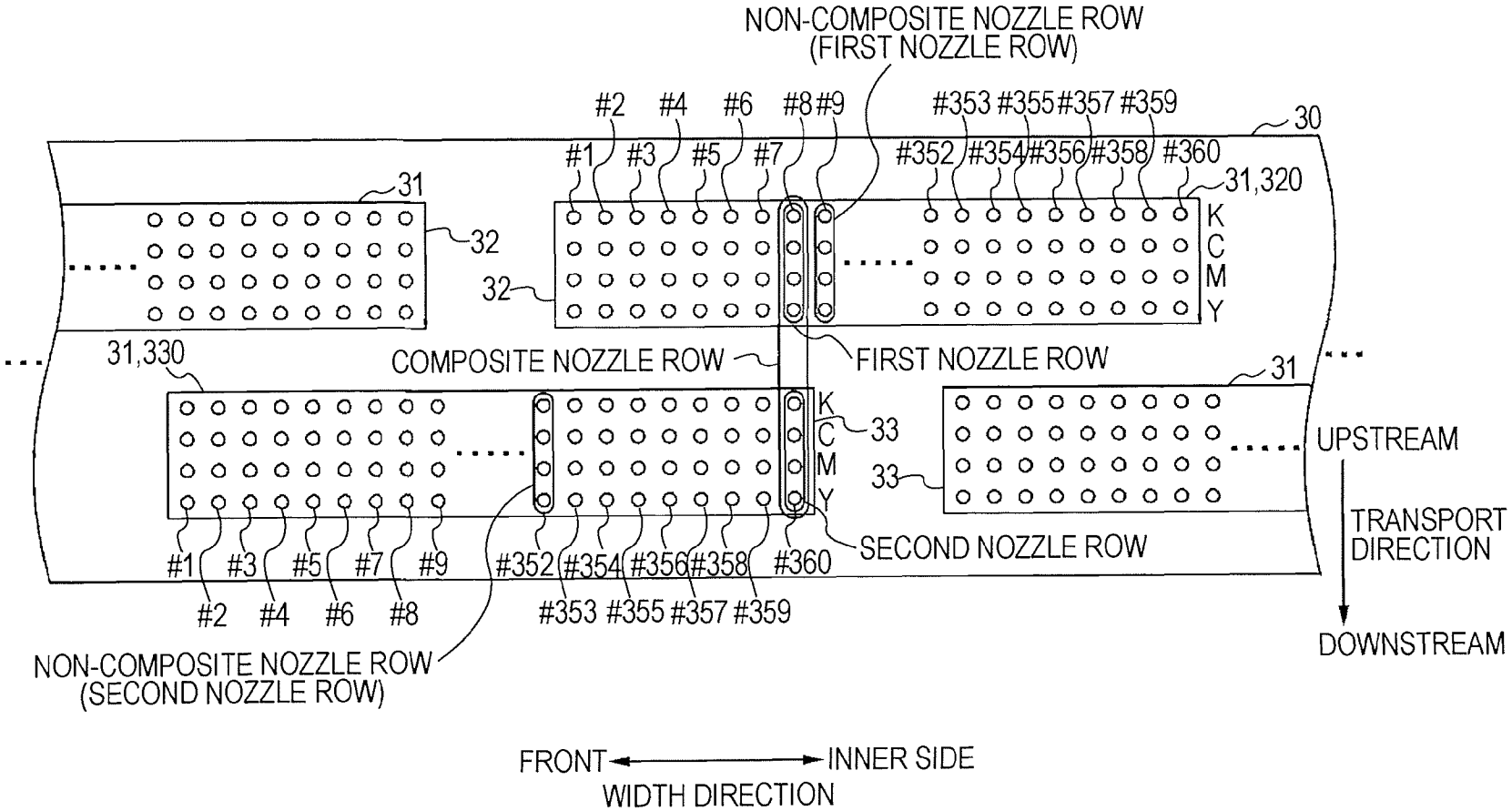
FIG. 3 is a schematic view illustrating a nozzle at a bottom of a head unit 30.

A configuration example of a printing system will be described with reference to FIGS. 1, 2A, 2B, and 3. FIG. 1 is a block diagram illustrating an overall configuration of a printing system according to the present embodiment. FIG. 2A is a cross-sectional view of a printer 1. FIG. 2B is a view illustrating a state in which a printer 1 transports a sheet of paper S (a medium). FIG. 3 is a schematic diagram illustrating a nozzle at a bottom of a head unit 30. FIG. 2B is a view in which a head unit 30 is seen in direction X illustrated in FIG. 2A.

The printing system includes a computer 60 and a printing apparatus (e.g., a line head ink jet printer, hereinafter referred to as simply a printer 1) which is one example of a fluid ejecting apparatus. The printing system which includes the printer 1 and the computer 60 can be referred to as "a fluid ejecting apparatus".

The computer 60 includes application software or a printer driver. The computer 60 converts multi-gradation image data generated by application software into binary printing data. Such conversion is realized by image processing through the printer driver.

The printer 1, which has received printing data from the computer 60, controls each unit (a transport unit 20 which is one example of a movement mechanism, a head unit 30 or the like) through a controller 10 and forms an image on the paper S which is one example of a medium. The inside status of the printer 1 is monitored by a detector group 40, and the controller 10 controls each unit based on the detection result.

The controller 10 is a control unit for controlling the printer 1. An interface unit 11 supports data exchange between the computer 60, which is an external apparatus, and the printer 1. A Central Processing Unit (CPU) 12 is an arithmetic processing unit for controlling the printer 1. A memory 13 has an area for storing a program of the CPU 12, a working area, or the like. The CPU 12 controls each unit through a unit control circuit 14 according to a program stored in the memory 13.

A transport unit 20 transports the paper S to a printable position and transports a predetermined transport amount of paper S in a transport direction (which corresponds to a predetermined direction) at the time of printing. The transport unit 20 includes a paper feed roller 21, a transport roller 22, a platen 23, and a paper discharge roller 24 as illustrated in FIG. 2A. The paper feed roller 21 is a roller for feeding paper S which is inserted into a paper insertion opening into the printer 1. The transport roller 22 is a roller for transporting the paper S which is fed by the paper feed roller 21 to a printable area. The platen 23 supports the paper S on which a printing task is being performed. The paper discharge roller 24 is a roller for discharging the paper S out of the printer 1.

The head unit 30 ejects ink, which is one example of a fluid, onto the paper S. The head unit 30 ejects ink onto the paper S which is being transported to form dots on the paper S, so that an image is printed on the paper S. The head unit 30 according to the present embodiment may immediately form dots corresponding to the paper width.

Next, a configuration of the head unit 30 according to the present embodiment will be described in detail with reference to FIG. 3. The head unit 30 includes a plurality of heads 31. Each head 31 includes a plurality of nozzles which are disposed at its bottom as ink ejecting units. A plurality of nozzles (in the present embodiment, four nozzles) which eject inks of different colors are lined up in a predetermined color order (in the present embodiment, black K→cyan C→magenta M→yellow Y) in a transport direction. Four nozzles lined up in the transport direction form a nozzle row, and a plurality of nozzle rows (in the present embodiment, 360 nozzle rows) are lined up at a regular interval (360 dpi) in a (paper) width direction (which corresponds to a cross direction) which crosses the transport direction. Each nozzle includes a pressure chamber (not illustrated) in which ink is reserved and a driving element (a piezoelectric element) which changes the capacity of the pressure chamber to eject ink.

The plurality of heads 31 are lined up in a zigzag form in the width direction. That is, the head units 31 are divided into upstream side heads 32 positioned at an upstream side of the transport direction and downstream side heads 33 positioned at a downstream side of the transport direction. The upstream side heads 32 and the downstream side heads 33 are alternately lined up in the width direction (i.e., . . . →the upstream side head 32→the downstream side head 33→the upstream side head 32 . . . ). The upstream side head 32 and the downstream side head 33 which are adjacent to each other in the width direction are disposed such that an end part of one head overlaps an end part of the other head in the width direction.

In FIG. 3, let us assume that the upstream side head labeled with reference numeral 32 is a first head 320 and the downstream side head labeled with reference numeral 33 is a second head 330. A front end (which corresponds to an end part of one end side) of the first head 320, which is the upstream side head 32, in the width direction overlaps an inner side end (which corresponds to an end part of the other end side) of the second head 330, which is the downstream side head 33, in the width direction, in the width direction. Therefore, M (in the present embodiment, M=8) nozzle rows (hereinafter, a nozzle row of the first head 320 is referred to as a first nozzle row) disposed on the front end of the first head 320 overlap M nozzle rows (hereinafter, a nozzle row of the second head 330 is referred to as a second nozzle row) disposed on the inner side end of the second head 330 in the width direction. As a result, M composite nozzle rows (see FIG. 3) in which the first nozzle rows and the second nozzle rows are lined up in the transport direction are formed.

Printing Processing Example

A printing processing example will be described below focusing on a color printing processing. The controller 10 receives a printing instruction and printing data from the computer 60, interprets various commands included in the printing data, and performs the following processing through respective units.

First, the controller 10 controls the paper feed roller 21 to rotate to feed the paper S on which printing is performed into the printer 1. The controller 10 controls the transport roller 22 to rotate to position the fed paper S at a printing start position. At this time, the paper S faces at least some nozzles of the head 31 (for convenience sake, this process is referred to as the first printing processing step).

Next, the paper S is transported by the transport roller 22 at a constant speed without being stopped and passes through below the head 31 (above the platen 23). While the paper S is passing through below the head 31, ink is intermittently ejected from each nozzle. As a result, a dot row (a raster line) which is configured by a plurality of dots lined up in the transport direction is formed on the paper S (for convenience sake, this process is referred to as the second printing processing step).

Finally, the controller 10 discharges the paper S on which an image is printed through the paper discharge roller 24 (for convenience sake, this process is referred to as the third printing processing step).

The second printing processing step will be further described below. In color printing processing, the controller 10 controls a nozzle to eject ink of a different color from each of nozzles which belong to the above-described nozzle row (or, the composite nozzle row) onto the transported paper S to dispose a plurality of color-overlapped dots in the transport direction, thereby forming a raster line for each nozzle row (or, each composite nozzle row). In the present embodiment, colors such as cyan C, magenta M and yellow Y are overlapped, and inks of the three colors are landed onto the same position on the paper S to form a color-overlapped dot.

(Inks of) three colors are overlapped in a particular color (ink) order. In the color order in which the three colors are overlapped, the case in which the inks of the three colors are ejected from nozzles which belong to the composite nozzle row to form a dot in which three colors are overlapped is different from the case in which inks of three colors are ejected from nozzles which belong to a nozzle row (for example, the first nozzle row which is positioned behind the composite nozzle row in the width direction or the second nozzle row which is positioned ahead of the composite nozzle row in the width direction (see FIG. 3), which are hereinafter referred to as a non-composite nozzle row) other than the composite nozzle row to form a dot in which three colors are overlapped.

The case of the non-composite nozzle row will be first described. Since the paper S is transported in the transport direction, ink ejected from a nozzle at an upstream side in the transport direction rapidly lands onto the paper S. In the non-composite nozzle row according to the present embodiment, since nozzles of various colors are lined up in an order of black K→cyan C→magenta M→yellow Y in the transport direction, the order in which the three colors are overlapped must be cyan C→magenta M→yellow Y.

On the other hand, in the case of the composite nozzle row, nozzles of various colors are lined up in the transport direction in an order of black K (of the first nozzle row)→cyan C (of the first nozzle row)→magenta M (of the first nozzle row)→yellow Y (of the first nozzle row)→black K (of the second nozzle row)→cyan C (of the second nozzle row) →magenta M (of the second nozzle row)→yellow Y (of the second nozzle row), and two nozzles (i.e., a nozzle of the first nozzle row and a nozzle of the second nozzle row) which are able to eject ink are present for each of cyan C, magenta M and yellow Y which are overlapped. The controller 10 controls a nozzle to eject ink through a nozzle of either of the first nozzle row and the second nozzle row for each color (i.e., for each of the three colors of cyan C, magenta M and yellow) to dispose a plurality of dots in which each three colors are overlapped in the transport direction, so that a raster line is formed. For example, a certain dot (e.g., a dot a) which belongs to a raster line is formed such that ink C, ink of magenta M and ink of yellow Y which are ejected from the first nozzle row are overlapped. A different dot (e.g., a dot b) is formed such that ink of cyan C ejected from the second nozzle and ink of magenta M and ink of yellow Y which are ejected from the first nozzle row overlap. A different dot (e.g., a dot c) is formed such that ink of cyan C and ink of magenta M which are ejected from the second nozzle and ink of yellow Y ejected from the first nozzle row overlap.

In the case of the composite nozzle row, since ink ejected from a nozzle at an upstream side in the transport direction rapidly lands onto the paper S, the order in which the three colors overlap is different from the case of the non-composite nozzle row and is not fixed. For example, in the case of the dot a, the order in which the three colors overlap is cyan C→magenta M→yellow Y as in the case of the non-composite nozzle row, while in the case of the dot b, the order is magenta M→yellow Y→cyan C, and in the case of the dot c, the order is yellow Y→cyan C→magenta M.

Selectivity

As described above, in the printer 1 according to the present embodiment, heads are disposed such that an end part of one head of the upstream side head 32 and the downstream head 33 which are adjacent to each other in the width direction overlaps an end part of the other head in the width direction to thereby form the composite nozzle row. The controller 10 controls a nozzle to eject ink onto the transported paper S from a nozzle of either of the first nozzle row and the second nozzle row of the composite nozzle row for each color and disposes a plurality of color-overlapped dots in the transport direction, thereby forming a raster line.

Advantages obtained through the above-described method according to the present embodiment are as follows. When the above-described method of the present embodiment is not used (for example, when heads which are adjacent to each other do not overlap each other, and a plurality of heads are straightly lined up in the width direction), since an interval between adjacent heads is too large due to an attachment error, a white stripe (a part in which a dot is not present) appears. However, according to the present embodiment, the occurrence of a white stripe is inhibited. Further, even if a head attachment error does not occur, adjacent heads may have a big head characteristic difference therebetween. When the characteristic difference appears in an image, there occurs a phenomenon that an image characteristic abruptly changes in a boundary between an image part formed by one head and an image part formed by the other head. However, according to the present embodiment, such a phenomenon is inhibited.

The above-described method of the present embodiment described above has been applied even to the conventional printer 1 in order to achieve the above-described advantages.

As described above, in both of the printer 1 according to the present embodiment and the printer 1 according to the related art, the controller 10 controls a nozzle to eject ink onto the transported paper S from a nozzle of either of the first nozzle row and the second nozzle row of the composite nozzle row for each color, but a ratio for selecting the first nozzle row and the second nozzle row is determined in advance. That is, from the point of view of the units of dots, which of ink ejected from the first nozzle row and ink ejected from the second nozzle row is used to form a dot is randomly determined, and at a point of view from units of rater lines, a ratio between ink ejected from the first nozzle row and ink ejected from the second nozzle row has a predetermined value (a method of realizing this will be described later).

That is, in both of the printer 1 according to the present embodiment and the printer 1 according to the related art, the controller 10 controls a nozzle to eject ink to dispose a plurality of color-overlapped dots so that a ratio of the number of dots formed by ink ejected from the first nozzle row (the second nozzle row) to the number of all of the dots which belong to the raster line can have a predetermined value, thereby forming a raster line. That is, the controller 10 controls a nozzle to eject ink to dispose a plurality of color-overlapped dots so that a ratio of an amount of ink on the raster line ejected from the first nozzle row (the second nozzle row) to a sum (i.e., an amount of all inks on the raster line) of an amount of ink on the raster line ejected from the first nozzle row and an amount of ink on the raster line ejected from the second nozzle row can have a predetermined value, thereby forming the raster line.

A method of setting the ratio (hereinafter, referred to as selectivity for convenience sake) in the conventional printer 1 and problems thereof will be first described below.

Next, a method of setting the selectivity according to the present embodiment and advantages thereof will be described. Thereafter, a method of resolving the problems of the related art will be described.

Figure 4:
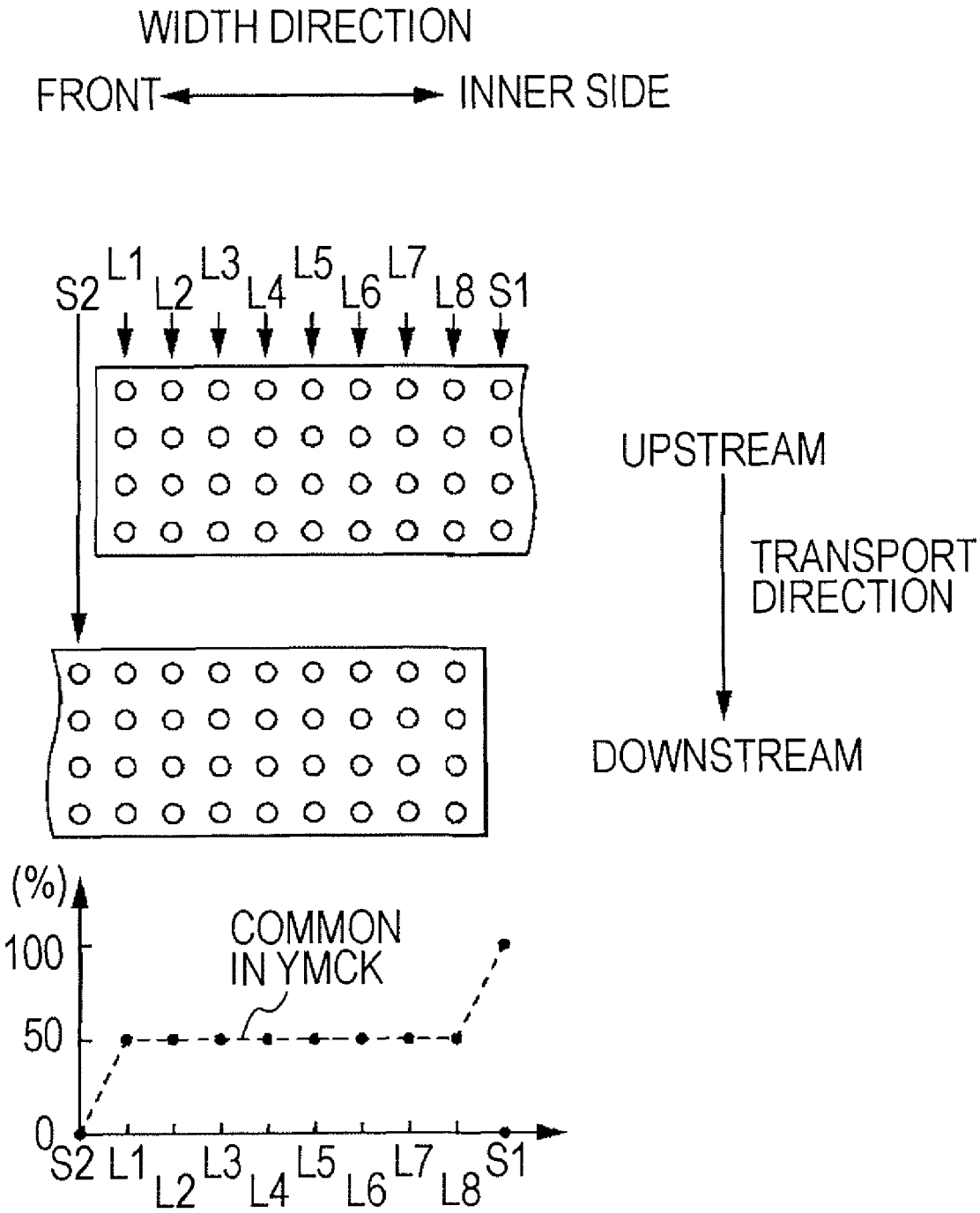
FIG. 4 is a schematic view illustrating selectivity of a conventional printer 1.

Setting of the Selectivity in the Conventional Printer 1 and Problems Thereof A method of setting the selectivity in the conventional printer 1 will be first described with reference to FIG. 4. FIG. 4 is a schematic view illustrating the selectivity of the conventional printer 1.

M (=8) composite nozzle rows are illustrated on a top part of FIG. 4. For convenience of explanation, L1 to L8 denote composite nozzle rows which are disposed in order from a composite nozzle row at a front side (one end side) to a composite nozzle row at an inner side (the other end side). S1 denotes a first nozzle row which is a non-composite nozzle row positioned further inside than the composite nozzle rows, and S2 denotes a second nozzle row S2 which is a non-composite nozzle row positioned ahead of the composite nozzle rows.

The selectivity of the first nozzle row for each of the composite nozzle rows L1 to L8 is illustrated on a bottom part of FIG. 4. For reference, the selectivity of the first nozzle row for the non-composite nozzle rows S1 and S2 is illustrated (naturally, since the non-composite nozzle row S1 is the first nozzle row, the selectivity of the first nozzle row for the non-composite nozzle row S1 is 100%, while since the non-composite nozzle row S2 is the second nozzle row, the selectivity of the first nozzle row for the non-composite nozzle row S2 is 0%).

FIG. 4 illustrates the selectivity of the first nozzle row but does not illustrate the selectivity of the second nozzle row. This is because due to a relation in which the selectivity of the second nozzle=100%—the selectivity of the first nozzle, if the selectivity of the first nozzle row is determined, the selectivity of the second nozzle row is automatically determined. For this reason, a method of setting the selectivity of the first nozzle row will be described below, but a method of setting the selectivity of the second nozzle row will not be described. The selectivity mentioned below means the selectivity of the first nozzle row.

As can be seen from FIG. 4, in the conventional printer 1, the selectivity for the composite nozzle rows was set equally to 50%, and the selectivity did not depend on a color difference or which one among the composite nozzle rows L1 to L8 ejects ink.

That is, from the point of view of the units of dots in the printer 1, which of the ink of cyan C ejected from the first nozzle row and ink of cyan C ejected from the second nozzle row is used to form a dot was randomly determined, and from the point of view from the units of raster lines, a ratio between ink of cyan C ejected from the first nozzle row and ink of cyan C ejected from the second nozzle row was 1:1. This was the same for the ink of magenta M, ink of yellow Y and ink of black K in addition to the ink of cyan C (here, in both the conventional example and the present embodiment, ink of black K is not overlapped with any other color). In the conventional example, the selectivity for ink of black K is 50% meaning that the selectivity is applied, for example, when black-and-white printing is performed.

Problem when the Selectivity is Set as Described Above

In the conventional example, it is simple and convenient to equally set the selectivity to 50%. However, when the selectivity is set as in the conventional example, there occurs a problem in that a dot which is formed by ink ejected from the composite nozzle row is different in color overlap order from a dot which is formed by ink ejected from the non-composite nozzle row (the non-composite nozzle rows S1 and S2, or the like).

That is, as already described in the "printing processing example" section, in the case of a dot formed by ink ejected from the non-composite nozzle row, a color overlap order must be an order of cyan C→magenta M→yellow Y. That is, the color overlap order must be identical to a color order of nozzles of the nozzle row lined up in the transport direction. In the case of a dot formed by ink ejected from the composite nozzle row, a color overlap order is not fixed.

As a color overlap order for the composite nozzle row, the following five cases may be obtained.

The first case is an order of cyan C→magenta M→yellow Y which is the same order as the color overlap order for the non-composite nozzle row. This case is generated by four combinations (the case in which ink of cyan C, ink of magenta M and ink of yellow Y which are ejected from the first nozzle row are overlapped, the case in which ink of cyan C, ink of magenta M and ink of yellow Y which are ejected from the second nozzle row are overlapped, the case in which ink of cyan C and ink of magenta M which are ejected from the first nozzle row and ink of yellow Y ejected from the second nozzle row are overlapped, and the case in which ink of cyan C ejected from the first nozzle row and ink of magenta M and ink of yellow Y which are ejected from the second nozzle row are overlapped).

A second case is an order of cyan C→yellow Y→magenta M. This case is generated by one combination (the case in which ink of cyan C ejected from the first nozzle row, ink of magenta M ejected from the second nozzle row and ink of yellow Y ejected from the first nozzle row are overlapped).

A third case is an order of magenta M→cyan C→yellow Y. This case is generated by one combination (the case in which ink of cyan C ejected from the second nozzle row, ink of magenta M ejected from the first nozzle row and ink of yellow Y ejected from the second nozzle row are overlapped).

A fourth case is an order of magenta M→yellow Y→cyan C. This case is generated by one combination (the case in which ink of cyan C ejected from the second nozzle row and ink of magenta M and ink of yellow Y which are ejected from the first nozzle row are overlapped).

A fifth case is an order of yellow Y→cyan C→magenta M. This case is generated by one combination (the case in which ink of cyan C and ink of magenta M which are ejected from the second nozzle row and ink of yellow Y ejected from the first nozzle row are overlapped).

As described above, the color overlap order for the composite nozzle row and the color overlap order for the non-composite nozzle row are different in four combinations out of 8 combinations. Since the selectivity is equally 50% regardless of a color difference, a dot of a color overlap order different from a color overlap order of the non-composite nozzle row is generated at a probability of one second (½).

Next, problems occurring when the color overlap order for the composite nozzle row and the color overlap order for the non-composite nozzle row are different will be described.

However, when a plurality of inks is overlapped, a state in which each ink bleeds into one another depends on an order in which an ink is overlapped. For example, in the case where ink is firstly overlapped, since no other ink is present on the spot on the paper S on which the ink lands (that is, since a landing spot on the paper S is dry), the ink slightly bleeds into the medium. On the other hand, in the case where ink is thirdly overlapped, since two inks are present on the spot on the paper S on which the ink lands (that is, since a landing spot on the paper S is sufficiently wet), the ink strongly bleeds into the medium.

Therefore, an image characteristic of an image (a pixel) formed by dots in which three colors of cyan C, magenta M and yellow Y are overlapped depends on the color overlap order of the three colors. For example, in the case of a dot in which three colors are overlapped in an order of cyan C→magenta M→yellow Y, ink of cyan C slightly bleeds into the medium, and ink of yellow Y strongly bleeds into the medium. Further, in the case of a dot in which three colors are overlapped in an order of magenta M→yellow Y→cyan C, ink of magenta M slightly bleeds into the medium, and ink of cyan C strongly bleeds into the medium. For this reason, even though the same three colors are overlapped, image characteristics of images (pixels) formed by the two dots are different from each other.

As described above, a color overlap order of a dot formed by ink ejected from the non-composite nozzle row must be cyan C→magenta M→yellow Y, while, for dots formed by ink ejected from the composite nozzle row, a dot of a color overlap order different from a color overlap order of the non-composite nozzle order is generated at a probability of one second (½). Therefore, an image part (which is an aggregate of raster lines) formed by ink ejected from the non-composite nozzle row is different in image characteristic from an image part formed by ink ejected from the composite nozzle row (an image characteristic difference may appear as a stripe on an image), and the image quality of an image (an overall image) deteriorates.

In order to resolve the problems (that is, in order to improve the image quality), for dots formed by ink ejected from the composite nozzle row, the occurrence of a dot of a color overlap order different from a color overlap order of the non-composite nozzle row has to be inhibited as much as possible.

Figure 5:
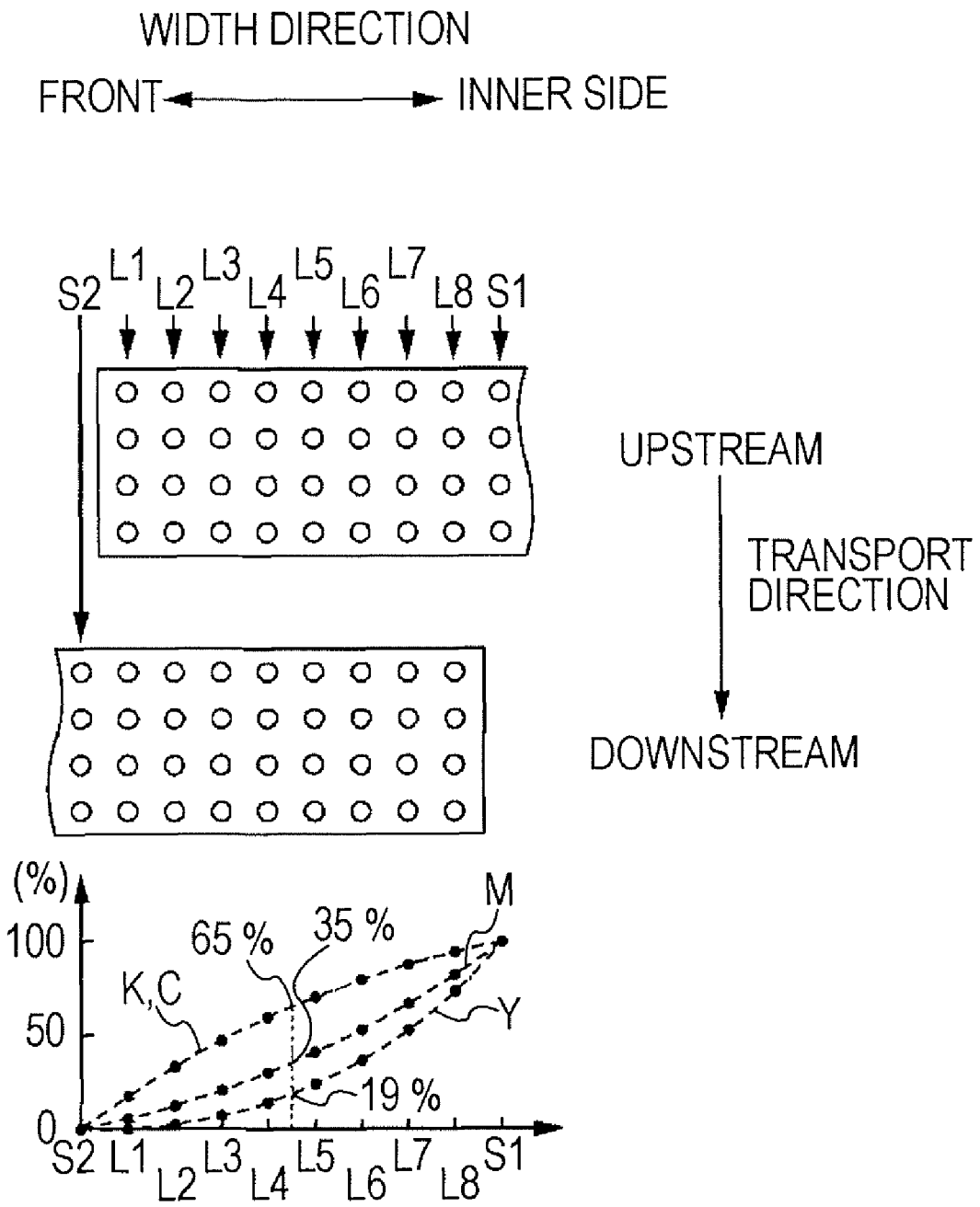
FIG. 5 is a schematic view illustrating selectivity of a printer 1 according to the present embodiment.

Setting of the Selectivity in the Printer 1 According to the Present Embodiment Next, a method of setting the selectivity in the printer 1 according to the present embodiment will be described with reference to FIG. 5. FIG. 5 is a schematic view illustrating the selectivity of the printer 1 according to the present embodiment. FIG. 5 has a view corresponding to FIG. 4. Since it is viewed in the same way as FIG. 4 its description is omitted.

As can be seen from FIG. 5, in the printer 1 according to the present embodiment, unlike the conventional printer 1, the selectivity for the composite nozzle row depends on a color difference or which nozzle row among the composite nozzle rows L1 to L8 ejects the ink.

First, the dependence of the selectivity on a color difference will be described below. In the present embodiment, as illustrated in FIG. 5, the selectivity of ink of a first color (for example, cyan C) is larger than the selectivity of ink of a second color (for example, magenta M) which is later in the color order than the first color in the transport direction. That is, the controller 10 of the printer 1 according to the present embodiment controls a nozzle to eject ink to form a raster line such that a ratio of the number of dots formed by ink of the first color (for example, cyan C) ejected from a first nozzle to the all of the dots, which belong to the raster line, formed by ink of the first color (for example, cyan C) is larger than a ratio of the number of dots formed by ink of the second color (for example, magenta M) ejected from the first nozzle to the number of all dots, which belong to the raster line, formed by ink of the second color (for example, magenta M). That is, the controller 10 controls a nozzle to eject ink such that a ratio (hereinafter, referred to as a first ratio) of A1 to "A1+A2" is larger than a ratio (hereinafter, referred to as a second ratio) of B1 to "B1+B2" to form the raster line, where A1 denotes an amount of ink of the first color (for example, cyan C) on the raster line ejected from the first nozzle row, A2 denotes an amount of ink of the first color (for example, cyan C) on the raster line ejected from the second nozzle row, B1 denotes an amount of ink of the second color (for example, magenta M) on the raster line ejected from the first nozzle row, and B2 denotes an amount of ink of the second color (for example, magenta M) on the raster line ejected from the second nozzle row.

As a result, the above-described problem can be resolved. That is, the present embodiment is the same as the conventional example in the fact that 8 combinations, described above, may be generated, and in four combinations out of the 8 combinations, a color overlap order of the composite nozzle row is different from a color overlap order of the non-composite nozzle row. However, unlike the conventional example in which the selectivity is equal regardless of a color difference, the selectivity depends on a color difference, so that a probability that a dot of a color overlap order different from a color overlap order of the non-composite nozzle row will be generated (a probability that 4 combinations will be generated) is reduced to less than one second (½).

That is, for dots formed by ink ejected from the composite nozzle row, a dot of a color overlap order different from a color overlap order of the non-composite nozzle row is difficult to generate. Therefore, an image characteristic difference between an image part formed by ink ejected from the non-composite nozzle row and an image part formed by ink ejected from the composite nozzle row is inhibited, whereby the image quality of an image (an overall image) is improved.

In the present embodiment, the relationship for the selectivity described above is satisfied with respect to three colors which are overlapped (that is, the relationship is satisfied for the case in which the first color is cyan C and the second color is yellow Y and the case in which the first color is magenta M and the second color is yellow Y as well as for the case in which the first color is cyan C and the second color is magenta M). That is, the selectivity of ink of cyan C is larger than the selectivity of ink of magenta M and ink of yellow Y which are later in color order than cyan C in the transport direction, and the selectivity of ink of magenta M is larger than the selectivity of ink of yellow Y which is later in color order than magenta M in the transport direction.

That is, the controller 10 of the printer 1 according to the present embodiment controls a nozzle to eject ink to form a raster line such that a ratio of the number of dots formed by ink of cyan C ejected from the first nozzle to the number of all of the dots, which belong to the raster line, formed by ink of cyan C is larger than a ratio of the number of dots formed by ink of magenta M ejected from the first nozzle to the number of all of the dots, which belong to the raster line, formed by ink of magenta M. Further, the controller 10 controls a nozzle to eject ink to form a raster line such that a ratio of the number of dots formed by ink of magenta M ejected from the first nozzle to the number of all of the dots, which belong to the raster line, formed by ink of magenta M is larger than a ratio of the number of the dots formed by ink of yellow Y ejected from the first nozzle to the number of all of the dots, which belong to the raster line, formed by ink of yellow Y.

That is, the controller 10 controls a nozzle to eject ink to satisfy a relationship of a ratio of C1 to "C1+C2">a ratio of M1 to "M1+M2">a ratio of Y1 to "Y1+Y2" to form the raster line, where C1 denotes an amount of ink of cyan C on the raster line ejected from the first nozzle row, C2 denotes an amount of ink of cyan C on the raster line ejected from the second nozzle row, M1 denotes an amount of ink of magenta M on the raster line ejected from the first nozzle row, M2 denotes an amount of ink of magenta M on the raster line ejected from the second nozzle row, Y1 denotes an amount of ink of yellow Y on the raster line ejected from the first nozzle row, and Y2 denotes an amount of ink of yellow Y on the raster line ejected from the second nozzle row.

As a result, for dots formed by ink ejected from the composite nozzle row, a dot of a color overlap order different from a color overlap order of the non-composite nozzle row is further difficult to generate. Therefore, an image characteristic difference between an image part formed by ink ejected from the non-composite nozzle row and an image part formed by ink ejected from the composite nozzle row is further inhibited, whereby the image quality of an image (an overall image) is further improved.

Further, in the printer 1 according to the present embodiment, as illustrated in FIG. 5, unlike the conventional printer 1, the selectivity for the composite nozzle row depends on which nozzle row among the composite nozzle rows L1 to L8 ejects ink. That is, the controller 10 according to the present embodiment controls a nozzle to eject a fluid onto the transported paper S from nozzles of either of the first nozzle row and the second nozzle row which belong to the composite nozzle row for each color and for each of M (=8) composite nozzle row and disposes a plurality of color-overlapped dots in the transport direction to form M (=8) raster lines. However, in the M (=8) formed raster lines, as the raster line is closer to the inner side (the other side), its selectivity is larger (as can be seen from FIG. 5, the selectivity increases in an order of L1→L2→L3→L4→L5→L6→L7→L8 for any color).

That is, the controller 10 controls a nozzle to eject ink to form a raster line such that as a raster line is closer to the inner side (the other side), in the M (=8) raster lines, a first ratio and a large second ratio are larger.

The present embodiment has the following advantages. That is, according to the present embodiment, in the M (=8) raster lines, a raster line which is positioned further inside (the other end side) is likely to have a larger number of dots formed by ink ejected from the first nozzle row of the first head 320, and a raster line which is positioned closer to a front side (one end side) is likely to have a larger number of dots formed by ink ejected from the second nozzle row of the second head 330. As described above, when a characteristic difference is generated between the first head 320 and the second head 330, the characteristic difference appears on an image. However, according to the present embodiment, in an image part formed by ink ejected from the composite nozzle row, a characteristic of the first head 320 noticeably appears in the inner side (the other end side), and a characteristic of the second head 330 noticeably appears in the front side (one end side). At the side (the other end side) further inside in the width direction more than an image part formed by ink ejected from the composite nozzle row, positioned is an image part (in this image part, only a characteristic of the first head 320 appears) formed by ink ejected from the first nozzle row of the first head 320 which is the non-composite nozzle row. At the front side (one end side) in the width direction more than an image part formed by ink ejected from the composite nozzle row, positioned is an image part (in this image part, only a characteristic of the second head 330 appears) formed by ink ejected from the second nozzle row of the second head 330 which is the non-composite nozzle row. Therefore, an image whose image characteristic smoothly (not abruptly) changes can be acquired. Accordingly, the image quality of an image can be improved.

Next, in the present embodiment, a value which is used as the selectivity for the composite nozzle row for each color and for each of the composite nozzle rows L1 to L8 will be described with reference to FIG. 5. On an x axis of FIG. 5, positioned are S2, L1 to L8 and S1 at a regular interval (that is, when an x-axis value of S2 is 0 and an x-axis value of S1 is 9, x-axis values of L1 to L8 are 1 to 8). In FIG. 5, each color is expressed by a quadratic curve, and all of the quadratic curves pass through a point (0,0) and a point (9,100). The quadratic curves of black K and cyan C further pass through a point (4.5,65). The quadratic curve of magenta M further passes through a point (4.5,35), and the quadratic curve of yellow Y further passes through a point (4.5,19).

The selectivity for each color and each of the composite nozzle rows L1 to L8 is set based on the quadratic curves. That is, the selectivity of black K and cyan C for the composite nozzle row Li (i=1 to 8) has a y-axis value corresponding to an x-axis value i in the quadratic curve which passes through a point (0,0), a point (9,100) and a point (4.5,65). The selectivity of magenta M for the composite nozzle row L1 has a y-axis value corresponding to an x-axis value i in the quadratic curve which passes through a point (0,0), a point (9,100) and a point (4.5,35). Similarly, the selectivity of yellow Y for the composite nozzle row Li has a y-axis value corresponding to an x-axis value i in the quadratic curve which passes through a point (0,0), a point (9,100) and a point (4.5,19).

As described above, in the present embodiment, black K is not overlapped with any other color. In the present embodiment, the selectivity for ink of black K with the above-described value means that the selectivity is applied, for example, when black-and-white printing is performed.

A Method of Determining which One of the First Nozzle Row and the Second Nozzle Row is used to Eject Ink for Forming Each Dot As described above, in the printer 1 according to the present embodiment, from the point of view of units of dots, which of the ink ejected from the first nozzle row and the ink ejected from the second nozzle row is used to form a dot is randomly determined, and from the point of view of units of raster lines, a ratio between ink ejected from the first nozzle row and ink ejected from the second nozzle row has a predetermined value.

In further detail, at a point of view from units of dots, which of ink of cyan C ejected from the first nozzle row and ink of cyan C ejected from the second nozzle row is used to form a dot is randomly determined. Further, at a point of view from units of raster lines, a ratio of C1 to "C1+C2" has a predetermined value illustrated in FIG. 5 for each of the composite nozzle rows L1 to L8, where C1 denotes an amount of ink of cyan C on the raster line ejected from the first nozzle row, and C2 denotes an amount of ink of cyan C on the raster line ejected from the second nozzle row (this can be applied to ink of different colors as well as ink of cyan C).

Figure 6:
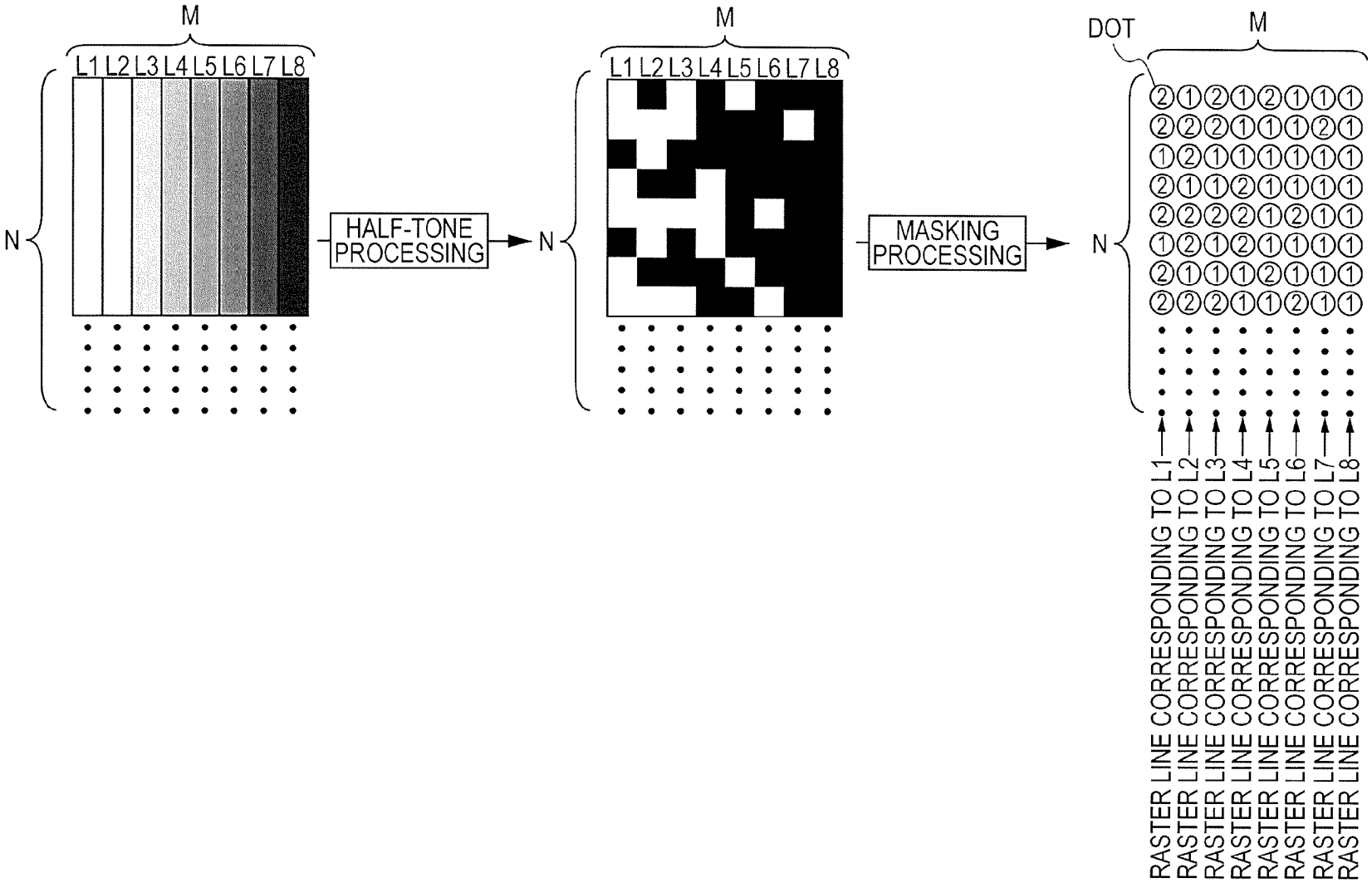
FIG. 6 is a view illustrating a method of determining which one of a first nozzle row and a second nozzle row is used to eject ink for forming each dot.

A method of determining which one of the first nozzle row and the second nozzle row is used to eject ink for forming each dot according to the present embodiment will be described below with reference to FIG. 6. FIG. 6 is a view illustrating a method of determining which one of the first nozzle row and the second nozzle row is used to eject ink for forming each dot.

The determining method uses a technique which is identical to half-tone processing (processing which converts multi-gradation data to binary data) which is commonly employed in image processing described above.

First, image data corresponding to an image illustrated in a left view of FIG. 6 is created. The image includes M (that is, the number of the composite nozzle rows in the present embodiment, M=8)×N (the number of dots disposed on the raster line) pixels, and image (pixel) data of each pixel includes multi-gradation (for example, 0 to 255) data.

The image is configured by M (8) density-stripe patterns. That is, all of gradation values of image (pixel) data of N pixels which belong to the same stripe pattern are the same, while gradation values of image (pixel) data of the M stripe patterns are different from each other.

The gradation values of the image (pixel) data of the M stripe patterns correspond to the selectivities (which are illustrated in FIG. 5) of cyan C for the composite nozzle rows L1 to L8, respectively. That is, when the selectivities of cyan C for the composite nozzle rows L1, L2, L3, L4, L5, L6, L7, and L8 illustrated in FIG. 5 are a1%, a2%, a3%, a4%, a5%, a6%, a7%, and a8%), the gradation values of image (pixel) data of the M stripe patterns are 255×(a1/100), 255×(a2/100), 255×(a3/100), 255×(a4/100), 255×(a5/100), 255×(a6/100), 255×(a7/100), and 255×(a8/100) from the left of FIG. 6, respectively.

Next, the multi-gradation image data is subjected to half-tone processing using a dither technique or an error-diffusion technique to acquire binary image data. An image illustrated in the middle of FIG. 6 is one example of an image formed by the binary image data (a black pixel represents image (pixel) data of "1", and a while pixel represents image (pixel) data of "0").

M×N image (pixel) data respectively correspond to dots (M×N dots) which belong to the M (8) raster lines, and which one of the first nozzle row and the second nozzle row is used to supply ink of cyan C to each dot is determined. That is, as can be understood from a comparison between the middle view and the left view of FIG. 6, a dot corresponding to image (pixel) data "1" is formed by the ink of cyan C ejected from the first nozzle row, and a dot corresponding to image (pixel) data "0" is formed by the ink of cyan C ejected from the second nozzle row (in the right view, numerals 1 and 2 represent a dot formed by the ink of cyan C ejected from the first nozzle row and a dot formed by the ink of cyan C ejected from the second nozzle row). That is, when the middle view is overlapped with the right view (when the middle view is used as a mask), a dot which is masked by a black part (pixel) represents a dot formed by the ink of cyan C ejected from the first nozzle row, and a dot which is not masked represents a dot formed by the ink of cyan C ejected from the second nozzle row.

The above-described processing is processing for cyan C, and the same processing is performed for other colors. For example, for magenta M, when the selectivities of magenta M for the composite nozzle rows L1, L2, L3, L4, L5, L6, L7, and L8 illustrated in FIG. 5 are b1%, b2%, b3%, b4%, b5%, b6%, b7%, and b8%), the gradation values of image (pixel) data of the M stripe patterns are 255×(b1/100), 255×(b2/100), 255×(b3/100), 255×(b4/100), 255×(b5/100), 255×(b6/100), 255×(b7/100), and 255×(b8/100), respectively. The gradation values are used to form an image (exactly, image data) which corresponds to an image illustrated in the left view of FIG. 6. Half-tone processing is performed for the image data, and then masking processing is performed. The above-described processing is equally performed for yellow Y and black K.

Other Embodiments

The above-described embodiment has been described focusing on a printing system having a printer, but it also discloses a fluid (ink) ejecting method. The above-described embodiment is to make the invention easily understood and does not intend to limit the scope of the invention. It would be understood that many changes or various modifications can be made without departing from the spirit of the invention, and the invention may include equivalents thereof. Particularly, an embodiment described below is included in the invention.

In the above-described embodiment, an ink jet printer has been described as an example of the fluid ejecting apparatus for performing the fluid ejecting method. However, the invention is not limited to an ink jet printer and may be applied to various industrial apparatuses as well as to a printer (a printing apparatus). For example, the invention may be applied to a printing apparatus which puts designs on fabric, a color filter manufacturing apparatus or a display manufacturing apparatus which is used to manufacture an organic EL display, a DNA chip manufacturing apparatus which coats a solution in which DNA is melted on a chip, and a circuit board manufacturing apparatus.

As a fluid ejecting method, a piezoelectric method in which a voltage is applied to a driving element (a piezoelectric element) to expand or contract an ink chamber to thereby eject an ink or a thermal method in which air bubbles are generated by a heating element, and a fluid is ejected by air bubbles may be used.

In the above-described embodiment, a line head ink jet printer with a non-movable head unit has been described as an example of an ink jet printer, but the invention is not limited to it and may be applied to a so-called serial printer with a movable head unit.

In the above-described embodiment, as a movement mechanism which moves a medium (a paper) relative to a head unit in a predetermined direction (a transport direction), an example of a transport unit which moves a medium (a paper) relative to a head unit has been described. That is, the printer according to the above-described embodiment has been described as a printer in which a head unit does not move but a medium (paper) moves in the transport direction, but the invention is not limited to it. For example, as the movement mechanism, a mechanism which moves a head unit relative to a medium (paper) may be used (that is, a printer in which not a medium (paper) but a head unit is moved in the transport direction may be used).

Figure 7:
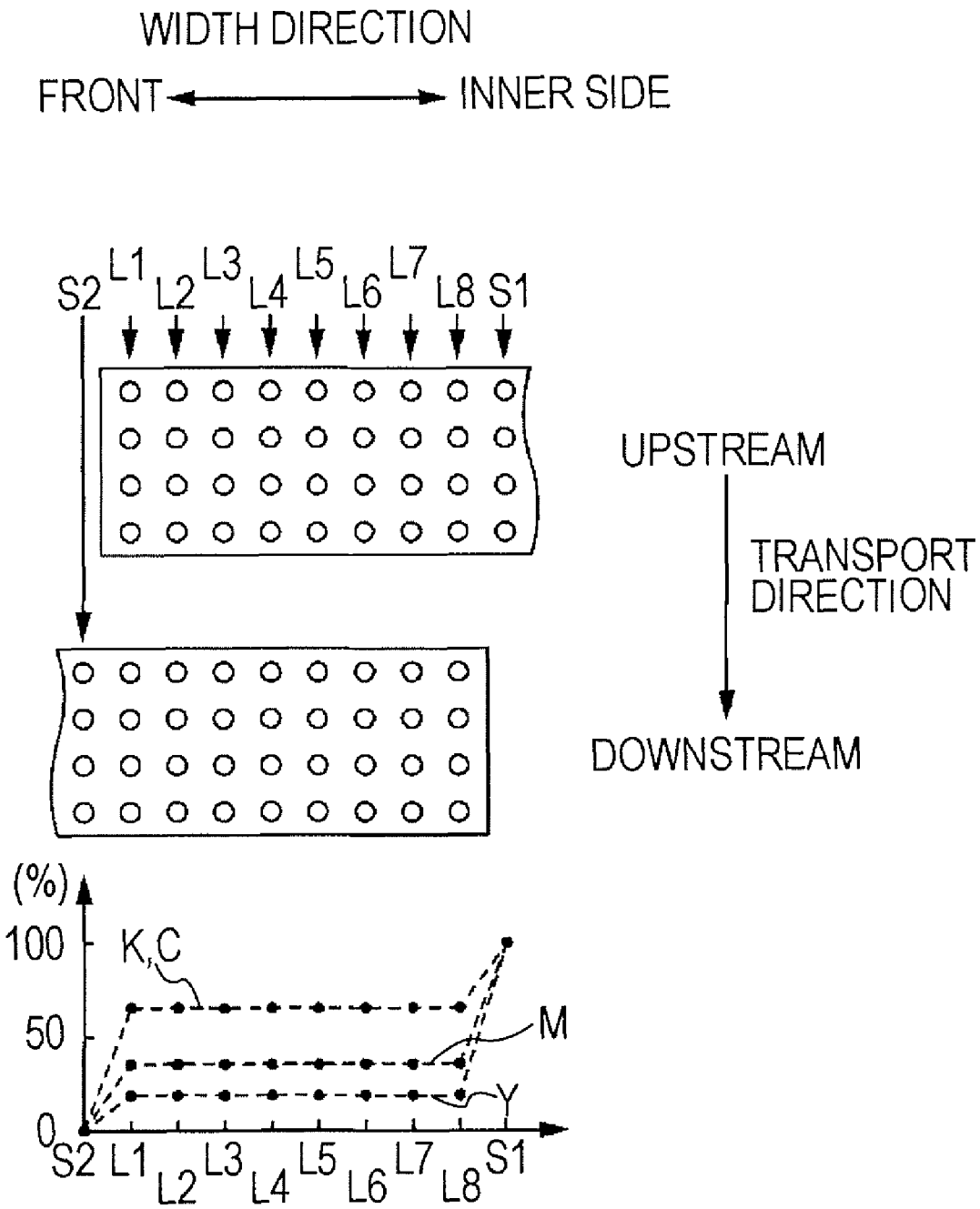
FIG. 7 is a schematic view illustrating selectivity of a printer 1 according to another embodiment.

In the above-described embodiment, the controller is configured to control a nozzle to eject an ink to form a raster line such that as a raster line is closer to the other side (the inner side), in the M (=8) raster lines, a first ratio and a large second ratio are larger, but the invention is not limited to it. For example, as illustrated in FIG. 7, ink may be ejected to form a raster line so that the M (8) raster lines can have the same first and second ratios as each another.

The printer according to the above-described embodiment uses four color inks of black K, cyan C, magenta M, and yellow Y and overlaps three colors of cyan C, magenta M and yellow Y. In the three colors, the first ratio is larger than the second ratio.

However, the invention is not limited to it. For example, black K may be overlapped, and in the four colors including black K, the first ratio may be larger than the second ratio. The printer may have ink of a color (for example, light cyan, light magenta, dark yellow, or the like) different from the four colors, and in the multiple colors including the ink of the different color, the first ratio may be larger than the second ratio.

In the above-described embodiment, an order in which black K, cyan C, magenta M, and yellow Y are lined up in the transport direction in the first nozzle row of the first head 320 is identical to an order in which the four colors are lined up in the transport direction in the second nozzle row of the second head 330. However, the invention is not limited to it, and an order in which the first color (for example, cyan C) and the second color (for example, magenta M) are lined up in the first nozzle row may be identical to an order in which they are lined up in the second nozzle row. For example, an order in which four colors are lined up in the first nozzle row may be black K→cyan C→magenta M→yellow Y, and an order in which four colors are lined up in the second nozzle row may be cyan C→magenta M→yellow Y→black K.

In the above-described embodiment, a composite nozzle row includes a single first nozzle row and a single second nozzle row, but the invention is not limited to it. For example, the composite nozzle row may include a single first nozzle row (a single second nozzle row) and two second nozzles rows (two first nozzle rows) which are adjacent to each other in the width direction. When the first nozzle row and the second nozzle row are not lined up on a straight line due to a head attachment error, the composite nozzle row may include two second nozzle rows (two first nozzle rows) which are adjacent to each other in the width direction and a single first nozzle row (a single second nozzle row) which is disposed between the two second nozzle rows in the width direction, and the above-described process (such as a process of forming a raster line) may be performed. Such a case (in this case, a fluid is ejected from the single first nozzle row and the two second nozzle rows which belong to the composite nozzle row to form a raster line corresponding to the composite nozzle row) is also one embodiment of the invention.

The controller may change the values of the first ratio and the second ratio according to the kind of medium or the type of printing mode. That is, in the above-described embodiment, a value of the first ratio or a value of the second ratio changes regardless of a kind of a medium and a type of a printing mode, but the values may change according to the kind of a medium and the type of printing mode. For example, for each of 10 (=5×2) combinations which are generated by five kinds of media and two types of printing modes, a combination of a value of the first ratio and a value of the second ratio may change.

In this case, a value of the first ratio or a value of the second ratio may be set to an appropriate value in view of a characteristic of a medium (how easy ink bleeds into the medium) or a characteristic of a printing mode (the size of the dot formed in a printing mode).

When density correction processing is added to the above-described embodiment, the image quality is improved, and it is more effective. Density correction processing refers to processing which includes, for example, processing of printing a test pattern on a medium, processing of reading the test pattern printed on the medium through a scanner, processing of obtaining a correction value for correcting density of an image according to the read density, and processing of correcting density of an image based on the obtained correction value.

In the above-described embodiment, as illustrated in FIG. 5, selectivity for each of the composite nozzle rows L1 to L8 is set based on a quadratic curve defined by coordinates of three points, but the invention is not limited to it. For example, the selectivity may be set based on a straight line (a polygonal line) in which coordinates of three points are tied. The selectivity may be set without using the quadratic curve or the straight line.

What is claimed is:

1. A fluid ejecting apparatus, comprising:

a head unit which includes a first head in which a plurality of first nozzle rows in each of which a nozzle for ejecting a fluid of a first color onto a medium and a nozzle for ejecting a fluid of a second color onto a medium are lined up in a color order in which the first color is earlier than the second color in a predetermined direction and the nozzles are lined up in a cross direction crossing the predetermined direction, and a second head which is disposed at a downstream side of the first head in the predetermined direction and in which a plurality of second nozzle rows in each where the two nozzles are lined up in a color order identical to the color order in the predetermined direction and are lined up in the cross direction, wherein the first nozzle row, which is positioned on an end part of one end side of the first head in the cross direction, overlaps the second nozzle row, which is positioned on an end part of the other end side of the second head in the cross direction, in the cross direction, so that a composite nozzle row in which the first nozzle row and the second nozzle row are lined up in the predetermined direction is formed;

a movement mechanism which moves the medium relative to the head unit in the predetermined direction; and a controller which controls a nozzle to eject a fluid onto the medium, which is moved by the movement mechanism, from nozzles of the first nozzle row and the second nozzle row which belong to the composite nozzle row for each color and disposes a plurality of color-overlapped dots in the predetermined direction to form a raster line, wherein the controller controls a nozzle to eject a fluid such that a first ratio of A1 to "A1+A2" is larger than a second ratio of B1 to "B1+B2" to form the raster line, where A1 denotes an amount of a fluid of the first color on the raster line ejected from the first nozzle row, A2 denotes an amount of a fluid of the first color on the raster line ejected from the second nozzle row, B1 denotes an amount of a fluid of the second color on the raster line ejected from the first nozzle row, and B2 denotes an amount of a fluid of the second color on the raster line ejected from the second nozzle row.

2. The liquid ejecting apparatus of claim 1, wherein, in the head unit, the M first nozzle rows which are positioned on an end part of the one end side and the M second nozzle rows which are positioned on an end part of the other end side overlap in the cross direction to form the M composite nozzles, and which the controller controls to eject a fluid onto the medium, which is moved by the movement mechanism, from nozzles of either of the first nozzle row and the second nozzle row which belong to the composite nozzle row for each color and for each of M composite nozzle rows and dispose a plurality of color-overlapped dots in the predetermined direction to form M raster lines and eject a fluid such that the first ratio and the second ratio are larger as the raster line in the M raster lines is closer to the other end side to form the raster line.

3. The fluid ejecting apparatus of claim 1, wherein the fluid ejecting apparatus is a printer apparatus, and the controller changes values of the first ratio and the second ratio according to a kind of the medium or a type of a printing mode.

4. The fluid ejecting apparatus of claim 1, wherein, in the first nozzle row and the second nozzle row, a nozzle for ejecting a fluid of cyan onto a medium, a nozzle for ejecting a fluid of magenta onto a medium, and a nozzle for ejecting a fluid of yellow onto a medium are lined up in a color order of cyan, magenta, and yellow in the predetermined direction, and the controller controls a nozzle to eject a fluid onto the medium, which is moved by the movement mechanism, from nozzles of either of the first nozzle row and the second nozzle row which belong to the composite nozzle row for each of three colors of cyan, magenta, and yellow, dispose a plurality of three color-overlapped dots in the predetermined direction to form the raster line, and eject a fluid to satisfy a relationship of a ratio of C1 to "C1+C2">a ratio of M1 to "M1+M2">a ratio of Y1 to "Y1+Y2" to form the raster line, where C1 denotes an amount of a fluid of cyan on the raster line ejected from the first nozzle row, C2 denotes an amount of a fluid of cyan on the raster line ejected from the second nozzle row, M1 denotes an amount of a fluid of magenta on the raster line ejected from the first nozzle row, M2 denotes an amount of a fluid of magenta on the raster line ejected from the second nozzle row, Y1 denotes an amount of a fluid of yellow on the raster line ejected from the first nozzle row, and Y2 denotes an amount of a fluid of yellow on the raster line ejected from the second nozzle row.

5. A method of ejecting a fluid, comprising:

preparing a head unit which includes a first head in which a plurality of first nozzle rows in each of which a nozzle for ejecting a fluid of a first color onto a medium and a nozzle for ejecting a fluid of a second color onto a medium are lined up in a color order in which the first color is earlier than the second color in a predetermined direction and are lined up in a cross direction crossing the predetermined direction and a second head which is disposed at a downstream side of the first head in the predetermined direction and in which a plurality of second nozzle rows in which the two nozzles are lined up in a color order identical to the color order in the predetermined direction are lined up in the cross direction, wherein the first nozzle row, which is positioned on an end part of one end side of the first head in the cross direction, overlaps the second nozzle row, which is positioned on an end part of the other end side of the second head in the cross direction, in the cross direction, so that a composite nozzle row in which the first nozzle row and the second nozzle row are lined up in the predetermined direction is formed; and ejecting a fluid onto the medium, which moves relative to the head unit in the predetermined direction, from nozzles of the first nozzle row and the second nozzle row which belong to the composite nozzle row for each color and disposing a plurality of color-overlapped dots in the predetermined direction to form a raster line, wherein a fluid is ejected such that a first ratio of A1 to "A1+A2" is larger than a second ratio of B1 to "B1+B2" to form the raster line, where A1 denotes an amount of a fluid of the first color on the raster line ejected from the first nozzle row, A2 denotes an amount of a fluid of the first color on the raster line ejected from the second nozzle row, B1 denotes an amount of a fluid of the second color on the raster line ejected from the first nozzle row, and B2 denotes an amount of a fluid of the second color on the raster line ejected from the second nozzle row.

* * * * *